US006739304B2

(12) United States Patent
Reinbold et al.

(10) Patent No.: US 6,739,304 B2
(45) Date of Patent: May 25, 2004

(54) CROSS-FLOW CYLINDER HEAD

(75) Inventors: David B. Reinbold, Kohler, WI (US); Robert W. Richards, Sheboygan, WI (US); Terrence M. Rotter, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 111 days.

(21) Appl. No.: 10/187,155

(22) Filed: Jun. 28, 2002

(65) Prior Publication Data

US 2004/0000284 A1 Jan. 1, 2004

(51) Int. Cl.[7] ..... F02F 1/06
(52) U.S. Cl. ..... 123/193.5
(58) Field of Search ..... 123/193.5

(56) References Cited

U.S. PATENT DOCUMENTS

| | | | |
|---|---|---|---|
| 1,172,612 A | 2/1916 | Kremer | |
| 1,301,007 A | 4/1919 | Roof | |
| 1,410,019 A | 3/1922 | Krause | |
| 1,469,063 A | 9/1923 | Wills | |
| 1,590,073 A | 6/1926 | Birkigt | |
| 1,684,955 A | 9/1928 | Goodwin | |
| 2,235,160 A | 3/1941 | Ljungstrom | |
| 2,459,594 A | 1/1949 | Smith | |
| 3,118,433 A | 1/1964 | Lechtenberg | 123/41.31 |
| 3,195,526 A | 7/1965 | Jordan | |
| 3,200,804 A | 8/1965 | Hensler et al. | |
| 3,314,408 A | 4/1967 | Fenton | |
| 3,407,741 A | 10/1968 | Weber et al. | |
| 3,457,804 A | 7/1969 | Harkness | |

(List continued on next page.)

FOREIGN PATENT DOCUMENTS

| | | |
|---|---|---|
| DE | 3120190 A1 | 5/1982 |
| GB | 355365 | 8/1931 |
| GB | 378216 | 8/1932 |
| WO | WO 86/04122 A1 | 7/1986 |
| WO | WO 00/43655 A1 | 7/2000 |

OTHER PUBLICATIONS

"Technical Innovations–Briggs & Stratton extends engine life", SAE Off–Highway Engineering, Oct. 2001, p. 4.
3 undated photographs of Briggs & Stratton balance system, admitted prior art.
Marketing literature concerning Briggs & Stratton AVS system, 2001 (2 pages).
Notes and photographs concerning Balance System of Briggs & Stratton shown at Louisville trade show in Jul, 2001 (3 pages of notes, 2 pages of photographs).
Information concerning gerators, obtained at www.vianenterprises.com, printed Mar. 2, 2002 (4 pages).
Information concerning crescent pumps, obtained at www-.animatedsoftware.com, printed Jul. 2, 2001 (1 page).
"Gerotor Lubricating Oil Pump for IC Engines", Manco et al., SAE Intn'l FL98 (San Francisco) (17 pages).
Undated photographs of Kohler Command–Single Automatic Compression Release mechanism, admitted prior art (1 page).
Undated photographs of Briggs & Stratton Automatic Compression Release mechanism, admitted prior art (1 page).
Undated photographs of Honda OHC Automatic Compression Release mechansim and cam follower, admitted prior art (3 pages).

*Primary Examiner*—Marguerite McMahon
(74) *Attorney, Agent, or Firm*—Quarles & Brady LLP

(57) ABSTRACT

An internal combustion engine having a cross-flow cylinder head with improved cooling. The cylinder head includes a pivotally mounted intake rocker arm which engages an intake push rod located proximal a first side of the cylinder head, and includes a pivotally mounted exhaust rocker arm which engages an exhaust push rod located proximal a second side of the cylinder head which is opposite to the first side of the cylinder head.

18 Claims, 5 Drawing Sheets

U.S. PATENT DOCUMENTS 3,561,416 A 2/1971 Kiekhaefer
3,751,080 A 8/1973 Bailey et al.
3,818,577 A 6/1974 Bailey et al.
4,030,179 A 6/1977 Schwarz
4,097,702 A 6/1978 Halsted
4,185,717 A 1/1980 Ford, Jr. et al.
4,198,879 A 4/1980 Hornak et al.
4,283,607 A 8/1981 Brightman
4,285,309 A 8/1981 Johansson
4,308,830 A 1/1982 Yamada et al.
4,332,222 A 6/1982 Papez
4,336,777 A 6/1982 Yanagihara et al.
4,366,787 A 1/1983 Gale
4,372,258 A 2/1983 Iwai ..... 123/73
4,380,216 A 4/1983 Kandler
4,391,231 A 7/1983 TateBe et al.
4,401,067 A 8/1983 Honda
4,414,934 A 11/1983 Vogl et al.
4,422,348 A 12/1983 Campbell
4,433,651 A 2/1984 Nakakita et al.
4,446,828 A 5/1984 Bauder et al.
4,452,194 A 6/1984 Watanabe
4,458,555 A 7/1984 Holtzberg et al.
4,507,917 A 4/1985 Kandler
4,510,897 A 4/1985 Hatz et al.
4,530,318 A 7/1985 Semple
4,534,241 A 8/1985 Remmerfelt et al.
4,548,253 A 10/1985 Funatani et al.
4,569,109 A 2/1986 Fetouh
4,570,584 A 2/1986 Uetsuji et al.
4,617,122 A 10/1986 Kruse et al.
4,622,933 A 11/1986 Fukuo et al.
4,644,912 A 2/1987 Umeha et al.
4,656,981 A 4/1987 Murata et al.
4,660,512 A 4/1987 Binder et al.
4,672,930 A 6/1987 Sumi
4,674,455 A 6/1987 Tsuboi
4,683,847 A * 8/1987 Fujikawa et al. ..... 123/90.2
4,684,267 A 8/1987 Fetouh
4,688,446 A 8/1987 Ishikawa
4,691,590 A 9/1987 Geringer et al.
4,696,266 A 9/1987 Harada
4,711,823 A 12/1987 Shiina
4,736,717 A 4/1988 Fujikawa et al.
4,793,297 A 12/1988 Fujii et al. ..... 123/90.23
4,802,269 A 2/1989 Mukai et al.
4,819,592 A 4/1989 van Ligten
4,819,593 A 4/1989 Bruener et al.
4,822,414 A 4/1989 Yoshikawa et al.
4,828,632 A 5/1989 Adam et al.
4,834,784 A 5/1989 Bidanset
4,836,045 A 6/1989 Lobig
4,838,909 A 6/1989 Bidanset
4,853,179 A 8/1989 Shiina
4,867,806 A 9/1989 Shiina
4,892,068 A 1/1990 Coughlin
4,898,133 A 2/1990 Bader
4,909,197 A 3/1990 Perr
4,926,814 A 5/1990 Bonde
4,928,550 A 5/1990 Sakai et al.
4,934,442 A 6/1990 Futamura et al.
4,949,687 A 8/1990 Emmersberger
4,958,537 A 9/1990 Diehl et al.
4,964,378 A 10/1990 Tamba et al. ..... 123/41.57
4,986,224 A 1/1991 Zuffi ..... 123/41.56
5,002,023 A 3/1991 Butterfield et al.
5,038,727 A 8/1991 Burns et al.
5,057,274 A 10/1991 Futamura et al.
5,085,184 A 2/1992 Yamada et al.
5,152,264 A 10/1992 Evans
5,163,341 A 11/1992 Murrish et al.
5,197,422 A 3/1993 Oleksy et al.
5,197,425 A 3/1993 Santi
5,207,120 A 5/1993 Arnold et al.
5,241,873 A 9/1993 Hormann
5,243,878 A 9/1993 Santi
5,243,938 A * 9/1993 Yan ..... 123/197.1
5,265,700 A 11/1993 Santi
5,282,397 A 2/1994 Harkness et al.
5,323,745 A 6/1994 Sato et al.
5,357,917 A 10/1994 Everts
5,370,093 A 12/1994 Hayes
5,375,571 A 12/1994 Diehl et al.
5,421,292 A * 6/1995 Hoffman et al. ..... 123/193.5
5,421,297 A 6/1995 Tamba et al. ..... 123/193.5
5,463,809 A 11/1995 Hoffman et al.
5,497,735 A 3/1996 Kern et al.
5,555,776 A 9/1996 Gazza
5,556,441 A 9/1996 Courtwright et al.
5,560,333 A 10/1996 Genouille
5,615,586 A 4/1997 Phillips et al.
5,651,336 A 7/1997 Rygiel et al.
5,711,264 A 1/1998 Jezek et al.
5,809,958 A 9/1998 Gracyalny
5,823,153 A 10/1998 Santi et al.
5,863,424 A 1/1999 Lee
5,887,678 A 3/1999 Lavender
5,904,124 A 5/1999 Poehlman et al.
5,964,198 A 10/1999 Wu
5,970,933 A * 10/1999 Ueda et al. ..... 123/193.5
5,979,392 A 11/1999 Moorman et al.
5,988,135 A 11/1999 Moorman et al.
6,006,721 A 12/1999 Shannon et al.
6,047,667 A 4/2000 Leppanen et al.
6,055,952 A 5/2000 Gau
6,076,426 A 6/2000 Genouille
6,109,230 A 8/2000 Watanabe et al.
6,116,205 A 9/2000 Troxler et al.
6,126,499 A 10/2000 Katayama et al.
6,170,449 B1 1/2001 Saiki et al.
6,213,081 B1 4/2001 Ryu et al.
6,269,786 B1 8/2001 Snyder et al.
6,293,981 B1 9/2001 Holderle et al.
6,395,049 B2 5/2002 Knodler et al.

* cited by examiner

CROSS-FLOW CYLINDER HEAD

CROSS REFERENCES TO RELATED APPLICATIONS

Not Applicable

STATEMENT REGARDING FEDERALLY SPONSORED RESEARCH

Not Applicable.

FIELD OF THE INVENTION

The present invention relates to internal combustion engines. In particular, the present invention relates to a cross-flow cylinder head having improved cooling.

BACKGROUND OF THE INVENTION

Internal combustion engines generally have a cylinder extending from a crankcase. The cylinder receives a reciprocating piston which closes off one end of the cylinder. A cylinder head closes off the opposing end of the cylinder, and defines a combustion chamber in the cylinder between the head and piston.

Fuel and combustion air is guided into the cylinder combustion chamber by a intake passage. The flow of fuel and combustion air through the intake passage is controlled by an intake valve. The intake valve can be opened to allow the flow of fuel and combustion air, and can be closed to block the flow of fuel and combustion air into the combustion chamber.

Hot exhaust gasses formed in the combustion chamber are exhausted through an exhaust passage which guides the exhaust gasses out of the combustion chamber. The flow of exhaust gasses out of the combustion chamber is controlled by an exhaust valve. The exhaust valve can be opened to allow gasses to flow out of the combustion chamber, and can be closed to prevent the flow of gasses out of the combustion chamber.

Combustion of the fuel and air in the combustion chamber creates a tremendous amount of heat which raises the temperature of the cylinder, cylinder head, and surrounding engine components. This heat can cause metallic parts, such as the cylinder and cylinder head to deform which is detrimental to the engine performance. In order to maintain engine performance, cooling the engine is an important aspect of engine design.

One known method for cooling engine is to circulate a cooling liquid in passageways surrounding the cylinder and cylinder head to extract heat from the metal parts. The liquid is routed through a radiator which extracts heat from the liquid prior to being recirculated past the maintains heat generating portions of the engine. Liquid cooled engines, however, are expensive compared to engines which depend upon air flowing past heat generating parts for cooling.

Known air-cooled engines, such as disclosed in U.S. Pat. No. 4,570,584, employ a fan which forces cooling air over the cylinder and cylinder head to cool the engine. The engine disclosed in U.S. Pat. No. 4,570,584 also incorporates a cross-flow cylinder head which has an intake passage and an exhaust passage which are aligned vertically and open in opposite directions. The exhaust passage is shielded from the forced cooling air generated by the fan, and thus does not benefit significant from the cooling ability of the forced air.

It would therefore be advantageous if an improved cylinder head was provided which takes full advantage of the cooling air generated by a fan.

SUMMARY OF THE INVENTION

The present invention provides an internal combustion engine which has improved cylinder head cooling. The engine includes a crankcase and a cylinder having a proximal end and a distal end. The proximal end of the cylinder is fixed to the crankcase. A cylinder head covers the distal end of the cylinder, and includes an intake passage and an exhaust passage. The intake passage opens toward a first side of the cylinder head for guiding combustible material to the cylinder. The exhaust passage opens toward a second side of the cylinder head which is opposite to the first side, and guides exhaust gasses away from the cylinder. An intake valve for controlling the flow of combustible material into the cylinder barrel through the intake passage includes an intake valve stem which extends through the cylinder head. An exhaust valve for controlling the flow of exhaust gasses out of the cylinder barrel through the exhaust passage includes an exhaust valve stem extending through the cylinder head. The intake valve stern and the exhaust valve stem define a central valve region therebetween. An intake rocker arm, is pivotally mounted relative to the cylinder head. The intake rocker arm has a first end engaging the intake valve stem and a second end extending toward the first side of the cylinder head, wherein pivotal movement of the intake rocker arm axially moves the intake valve stem to move the intake valve between an open position and a closed position. An exhaust rocker arm is pivotally mounted relative to the cylinder head. The exhaust rocker arm has a first end engaging the exhaust valve stem and a second end extending toward the second side of the cylinder head, wherein pivotal movement of the exhaust rocker arm axially moves the exhaust valve stem to move the exhaust valve between an open position and a closed position. An intake push rod adjacent to the first side of the cylinder head extends parallel to the intake push rod, and engages the intake rocker arm to pivot the intake rocker arm. An exhaust push rod adjacent to the second side of the cylinder head extends parallel to the exhaust push rod, and engages the exhaust rocker arm second end to pivot the exhaust rocker arm.

A general objective of the present invention is to improve the cooling of the cylinder head. This objective is accomplished by locating the push rods adjacent opposite sides of the cylinder head to clear out the central valve region between the valve stems, and allow more cooling air to flow through the region.

This and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE PREFERRED EMBODIMENT

Figure 1:
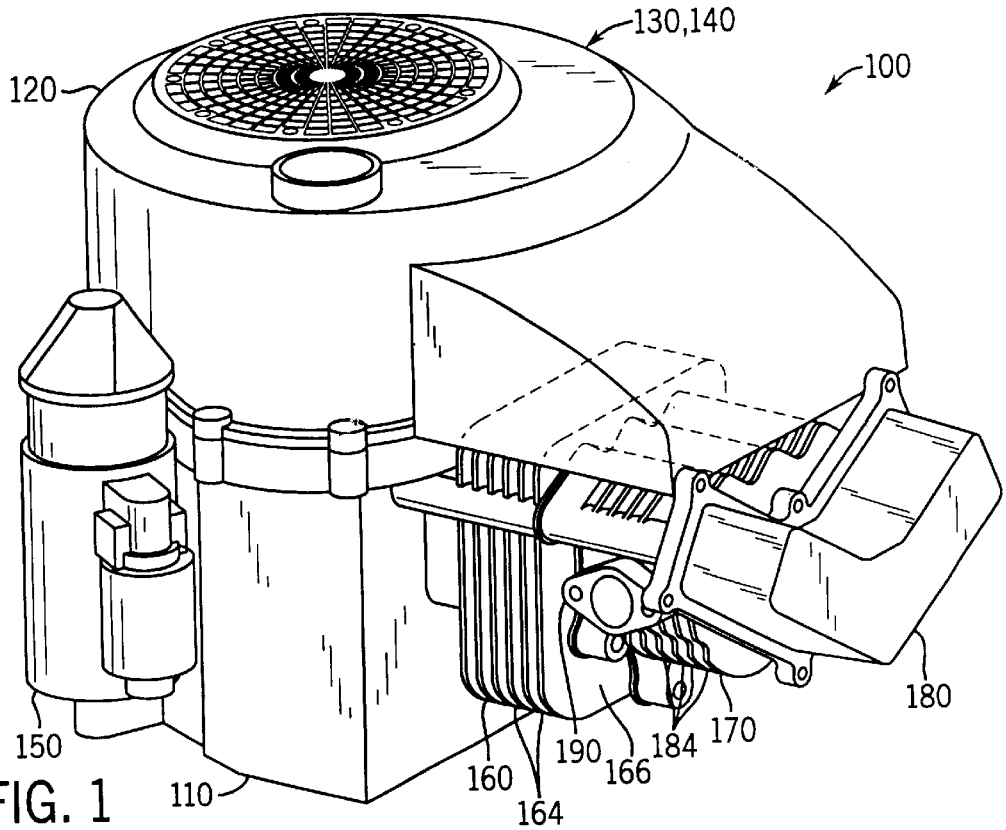
FIG. 1 is a first perspective view of a single cylinder engine, taken from a side of the engine on which are located a starter and cylinder head.
Figure 2:
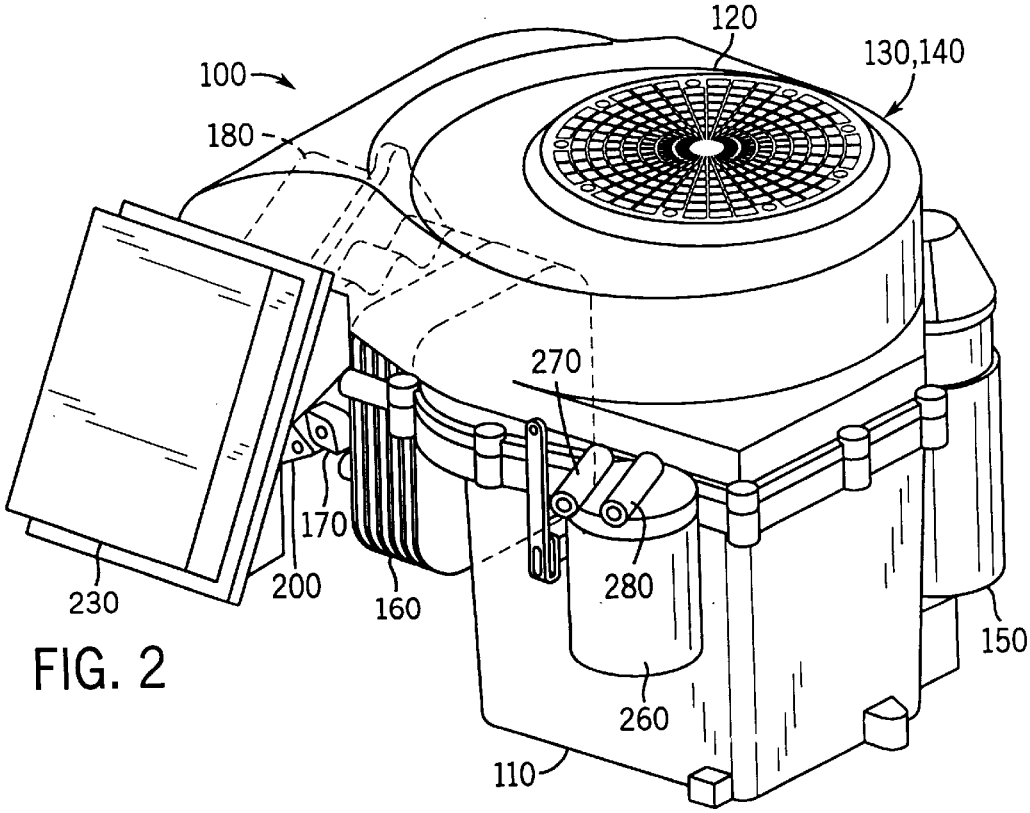
FIG. 2 is a second perspective view of the single cylinder engine of FIG. 1, taken from a side of the engine on which are located an air cleaner and oil filter.

Referring to FIGS. 1 and 2, a new single cylinder, 4-stroke, internal combustion engine 100 designed by Kohler Co. of Kohler, Wis. includes a crankcase 110 and a blower housing 120, inside of which are a fan 130 and a flywheel 140. The blower housing guides air from the fan over a cylinder and cylinder head. The engine 100 further includes a starter 150, a cylinder 160, a cylinder head 170, and a rocker arm cover 180.

The cylinder 160 has a proximal end 162 which is fixed to, and opens into, the crankcase 110. A piston 210 received in the cylinder reciprocates within the cylinder 160, and is pivotally linked to a connecting rod 420 rotatably linked to a crankshaft 220 (see FIG. 7) rotatably mounted in the crankcase 110, wherein reciprocation of the piston 210 rotates the crankshaft 220, a well as, the fan 130 and the flywheel 140, which are coupled to the crankshaft 220. The rotation of the fan 130 forces cooling air over the cylinder 160 and cylinder head 162, and the rotation of the flywheel 140, causes a relatively constant rotational momentum to be maintained. Fins 164 extending from the cylinder 160 radiate heat generated by the engine operation to cool the engine 100.

As shown in FIGS. 3–7, the cylinder head 170 is fixed to a distal end 166 of the cylinder 160, and includes a body 172 and a rocker arm support bridge 174 fixed to, and spaced from the body 172. An exhaust passage 190 shown in FIG. 1 and an intake passage 200 shown in FIG. 2 are formed through the body 172, and extend into a space 176 between the body 172 and bridge 174. The intake passage 200 guides combustible material, such as a mixture of fuel and air, from one side 178 of the cylinder head 179 to the cylinder 166. The exhaust passage 190 guides exhaust gasses from the cylinder 160 to an opposite side 182 of the cylinder head 170. Fins 184 extending from the cylinder head 170 guides cooling air over the passages 190, 200, and radiate heat to cool the cylinder head 170 during engine operation.

Figure 7:
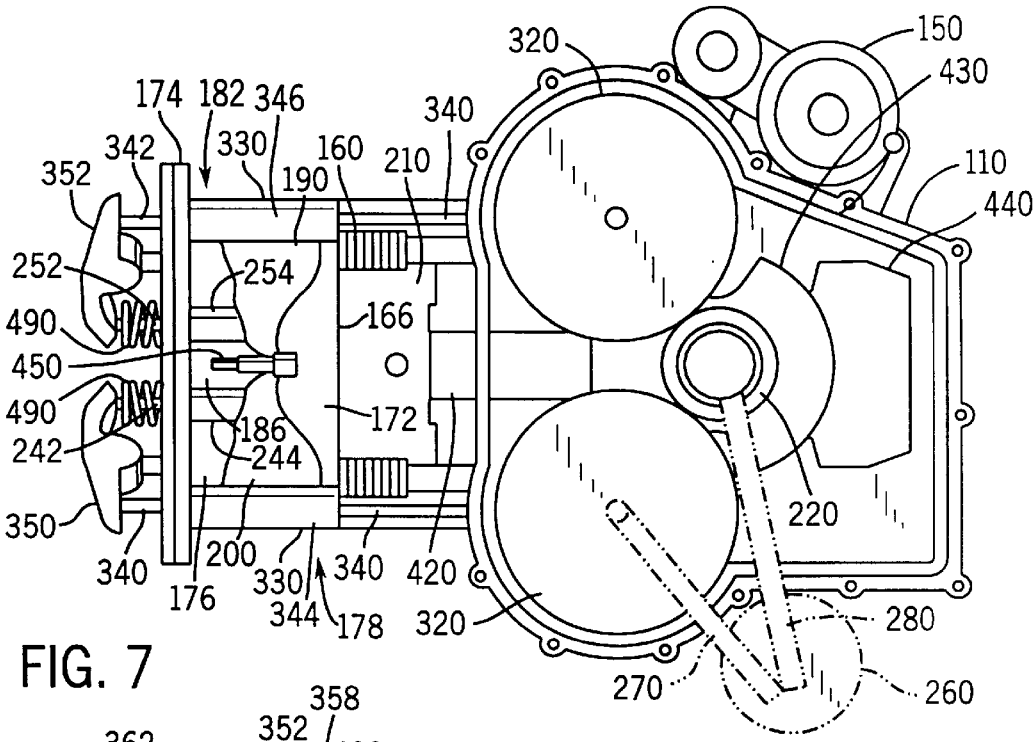
FIG. 7 is a top view of the single cylinder engine of FIG. 1, showing internal components of the engine in grayscale.
Figure 8:
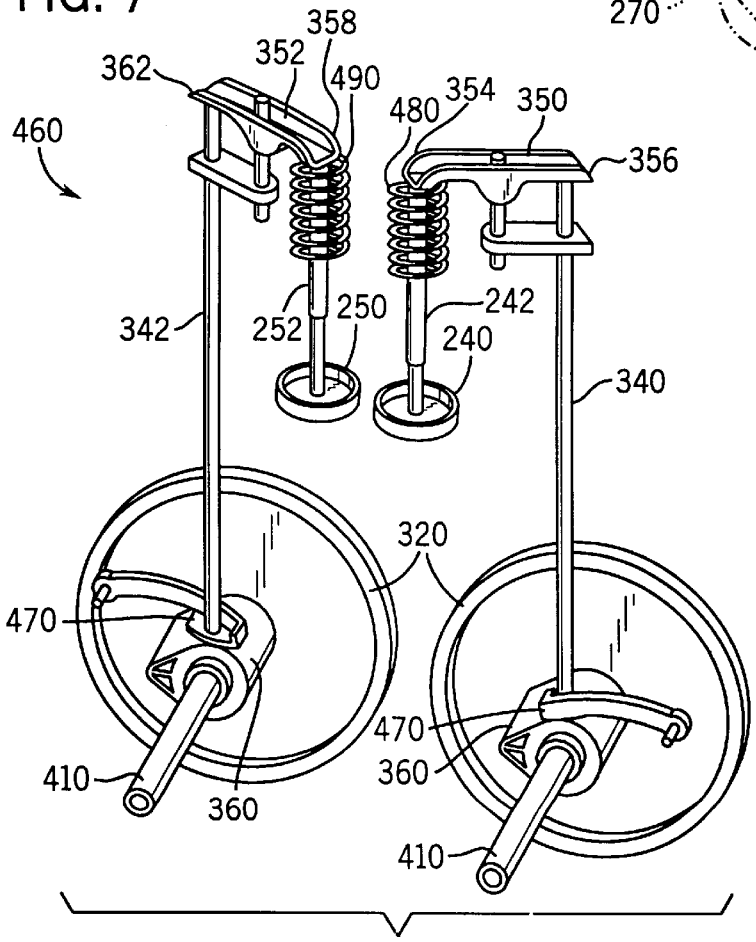
FIG. 8 is a perspective view of components of a valve train of the single cylinder engine of FIG. 1.
Figure 9:
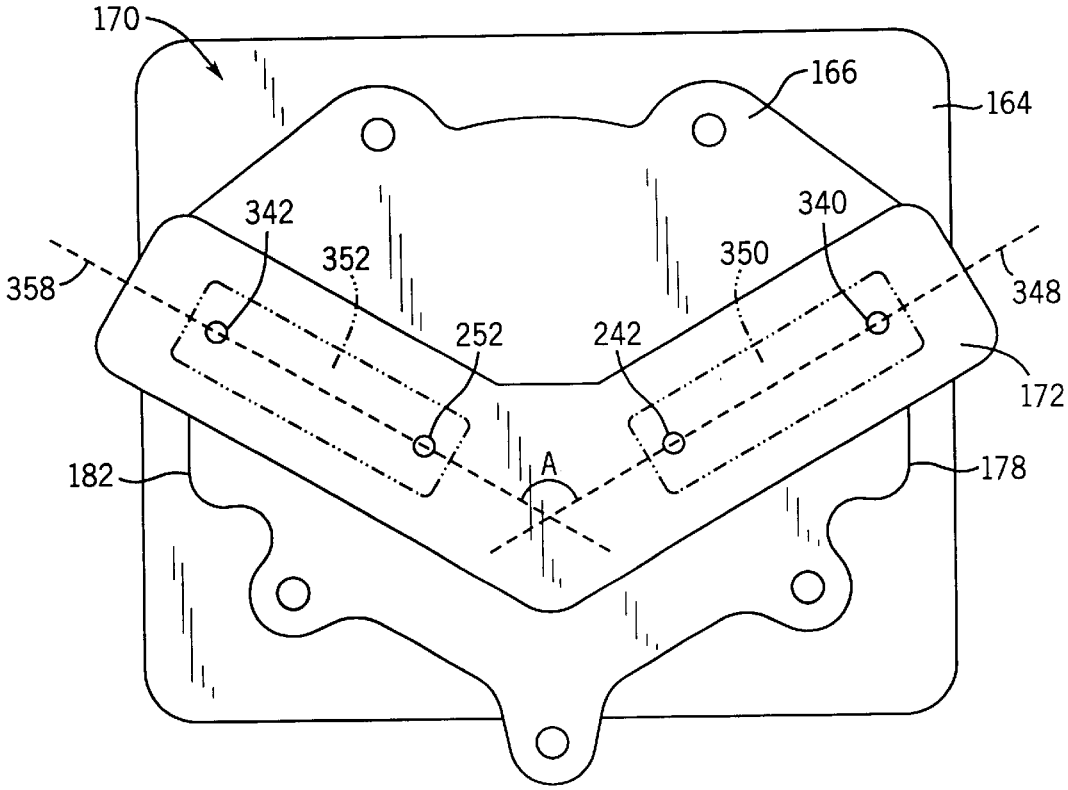
FIG. 9 is a plan view of the cylinder head of the single cylinder engine of FIG. 1 with the rocker arm cover and cylinder head fins removed.

Referring to FIGS. 7–9, the passages 190, 200 are oriented substantially perpendicular to the flow of cooling air forced past the cylinder head 170 by the fan 130 to provide improved cooling of the cylinder head 170. Advantageously, the exhaust passage 190 which guides hot exhaust gasses from the cylinder 160 projects out from cylinder head body 172 toward the bridge 174 and into the path of the fan-forced cooling air to further improve cooling of the cylinder head 170.

An intake valve 240 in the cylinder head 170 controls the flow of combustible material into the cylinder 160 through the intake passage 200. The intake valve 240 includes a valve stem 242 which extends through the cylinder head 170 and bridge 174, and engages an intake rocker arm 350. An exhaust valve 250 in the cylinder head 170 controls the flow of exhaust gasses out of the cylinder 160 through the exhaust passage 190. As in the intake valve 240, the exhaust valve 250 includes a valve stem 252 which extends through the cylinder head 170 and bridge 174 to engage an exhaust rocker arm 352. Preferably, the valve stems 242, 252 extend through valve stem tubes 244, 254 extending between the cylinder head body 172 and bridge 3 wherein the valve stem tubes 244, 254 support the bridge 174 spaced from the body. The intake and exhaust valve stems 242, 252, and their respective tubes 244, 254 if present, define a central valve region 186 between the valve stems 242, 252 which is open to the flow of cooling air from the fan 130 to improve cylinder head 172 and exhaust passage cooling.

The rocker arm cover 180 (shown in FIG. 3) is fixed to the bridge 174, and covers the rocker arms 350, 352 which control the intake valve 240 and exhaust valve 250, respectively. The intake rocker arm 350 is pivotally mounted to the bridge 174, and has a first end 354 engaging the intake valve stem 242, such that pivotal movement of the intake rocker arm 350 axially moves the intake valve stem 242 to move the valve 240 between an open position and a closed position. A second end 356 of the intake rocker arm 350 extends toward the one side 178 of the cylinder head 170 proximal the intake passage 200, and engages an intake push rod 340.

The exhaust rocker arm 352 is pivotally mounted to the bridge 174, and has a first end 358 engaging the exhaust valve stem 252, such that pivotal movement of the exhaust rocker arm 352 axially moves the exhaust valve stem 252 to move the exhaust valve 250 between an open position and a closed position. A second end 362 of the exhaust rocker arm 352 extends toward the opposite side 182 of the cylinder head 170 proximal the exhaust passage 190, and engages an exhaust push rod 342.

The push rods 340, 342 extend between the respective rocker arms 350, 352 and a pair of cams 360 (see FIG. 8) within the crankcase 110. Preferably, the push rods 340; 342 extend through push rod tubes 344, 346 extending between the cylinder head body 172 and bridge 174, wherein the push rod tubes 344, 346 support the bridge 174 spaced from the body 172. Advantageously, the push rods 340, 342, and their respective tubes 344, 346, are located out of the central valve region 186 to allow the cooling air to flow through the central valve region 186 relatively unimpeded. As shown in FIG. 9, the intake push rod 340 and intake valve stem 242, and their respect tubes 344, 244 if any, lie in a first plane 348. Likewise, the exhaust push rod 342 and exhaust valve stem 252, and their respective tubes 346, 254 if any, lie in a second plane 358. Preferably, the intake push rod 340 and exhaust push rod 342 are positioned, such that the planes 348, 358 intersect to form an angle, A. Most preferably, the angle, A, is at least 90° to ensure the push rods 340, 342 are spaced a distance from the central valve region 186.

The intake push rod 340 extends through the cylinder head body 166 adjacent the intake passage 200, and the exhaust push rod 342 extends through the cylinder head body 166 adjacent the exhaust passage 190. Advantageously, positioning the respective push rods 340, 342 adjacent the respective passages 190, 200, further opens up the area between the bridge 174 and body 166 beyond the central valve region 186 to further improve the cooling of the cylinder head 170 by the fan cooling air.

A pair of springs 480, 490 positioned between the cylinder head bridge 174 and the rocker arms 350, 352 provide force tending to rock the rocker arms 350, 352 in directions tending to close the valves 240, 250, respectively. Further as a result of this forcing action of the springs 480, 490 upon the rocker arms 350, 352, the push rods 340, 342 are forced back to their original positions.

Referring specifically to FIG. 2, the engine 100 further includes an air filter 230 coupled to the air intake port 200, which filters the air required by the engine prior to the providing of the air to the cylinder head 170. Also as shown in FIG. 2, the engine 100 includes an oil filter 260 through which the oil of the engine 100 is passed and filtered. Specifically, the oil filter 260 is coupled to the crankcase 110 by way of incoming and outgoing lines 270, 280, respectively, whereby pressurized oil is provided into the oil filter and then is returned from the oil filter to the crankcase.

Figure 3:
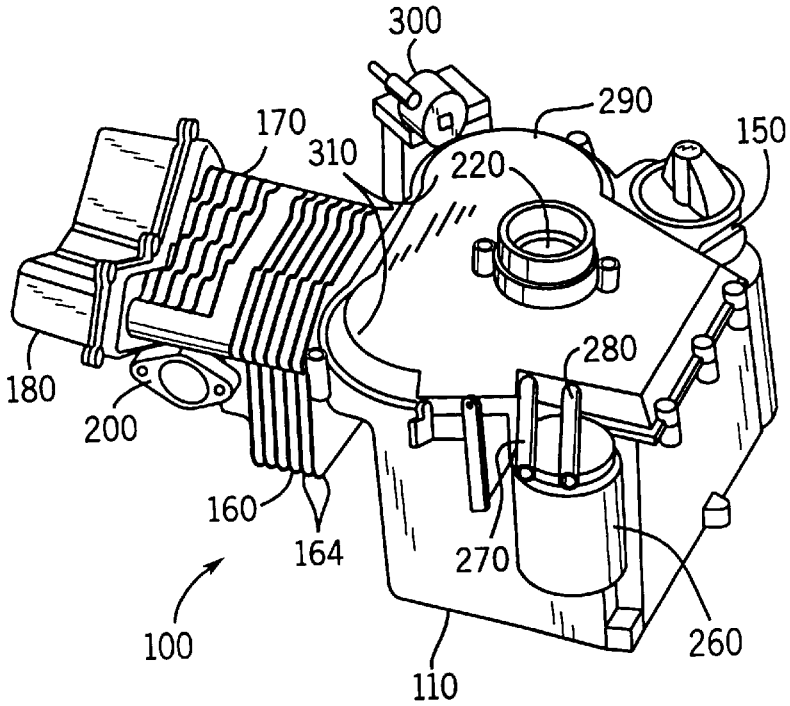
FIG. 3 is a third perspective view of the single cylinder engine of FIG. 1, in which certain parts of the engine have been removed to reveal additional internal parts of the engine.
Figure 4:
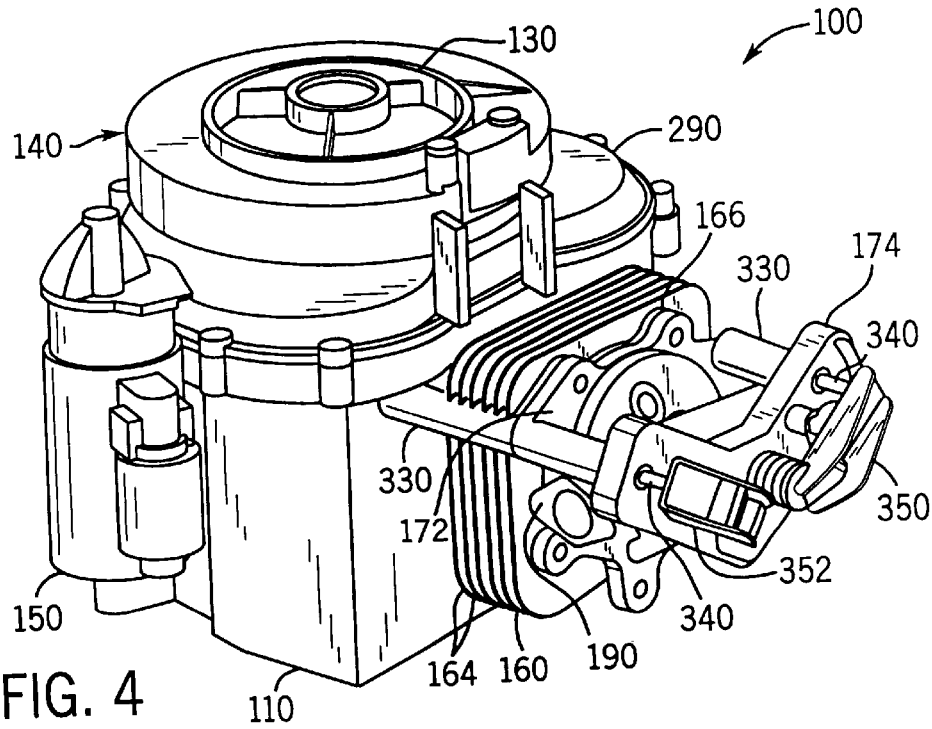
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose a top 290 of the crankcase 110. With respect to FIG. 3, in which both the fan 130 and the flywheel 140 are also removed, a coil 300 is shown that generates an electric current based upon rotation of the fan 130 and/or the flywheel 140, which together operate as a magneto. Additionally, the top 290 of the crankcase 110 is shown to have a pair of lobes 310 that cover a pair of gears 320 (see FIGS. 5 and 7–8). With respect to FIG. 4, the fan 130 and the flywheel 140 are shown above the top 290 of the crankcase 110. Additionally, FIG. 4 shows the engine 100 without the cylinder head fins and without the rocker arm cover 180, to more clearly reveal a pair of tubes 330 through which extend the respective push rods 340.

Figure 5:
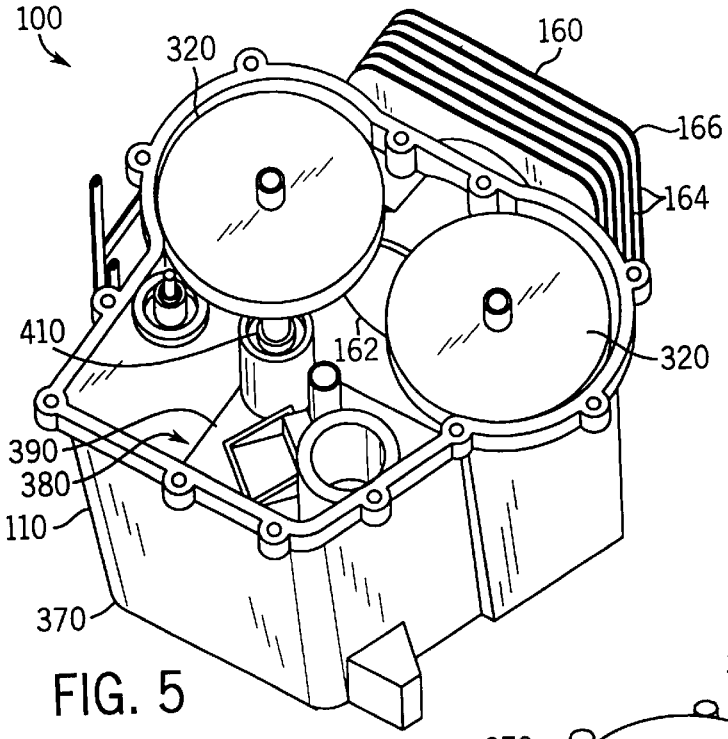
FIG. 5 is fifth perspective view of portions of the single cylinder engine of FIG. 1, in which a top of the crankcase has been removed to reveal an interior of the crankcase.
Figure 6:
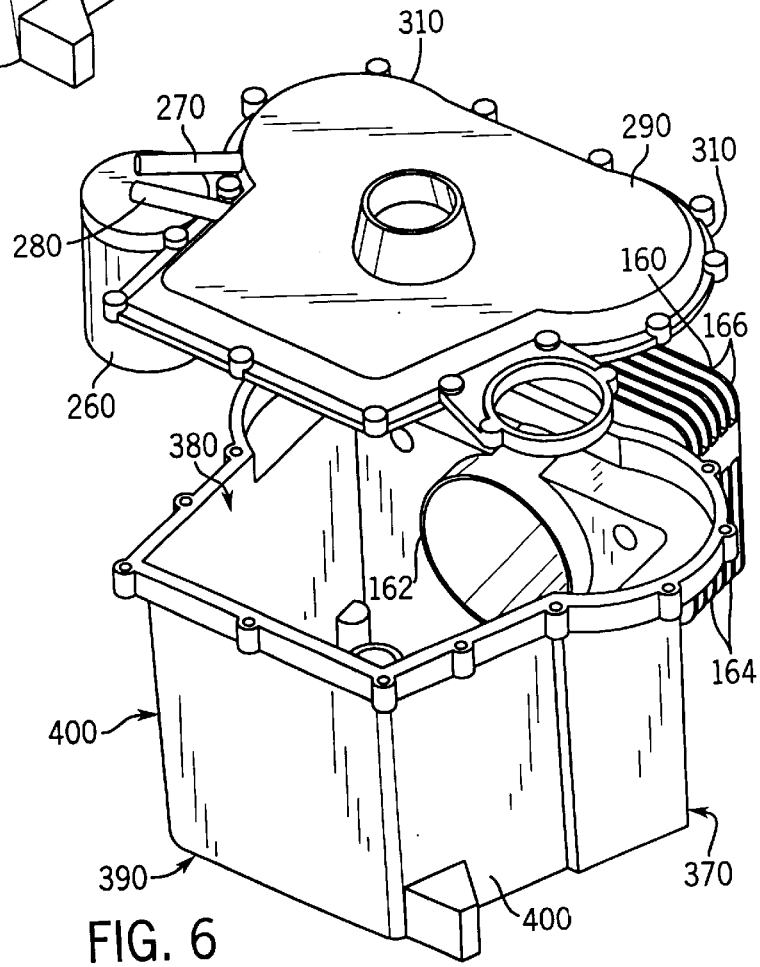
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the top 290 of the crankcase 110 removed from a bottom 370 of the crankcase 110 to reveal an interior 380 of the crankcase. Additionally in FIGS. 5 and 6, the engine 100 is shown in cut-away to exclude portions of the engine that extend beyond the cylinder 160 such as the cylinder head 170. With respect to FIG. 6, the top 290 of the crankcase 110 is shown above the bottom 370 of the crankcase in an exploded view.

In this embodiment, the bottom 370 includes not only a floor 390 of the crankcase, but also all six side walls 400 of the crankcase, while the top 290 only acts as the roof of the crankcase. The top 290 and bottom 370 are manufactured as two separate pieces such that, in order to open the crankcase 110, one physically removes the top from the bottom. Also, as shown in FIG. 5, the pair of gears 320 within the crankcase 110 are supported by and rotate upon respective shafts 410, which in turn are supported by the bottom 370 of the crankcase 110.

Referring to FIG. 7, a top view of the engine 100 is provided in which additional internal components of the engine are shown in grayscale. In particular, FIG. 7 shows the piston 210 within the cylinder 160 coupled to the crankshaft 220 by the connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320, and thus communicates rotational motion to the gears.

In the present embodiment, the shafts 410 upon which the gears 320 are supported are capable of communicating oil from the floor 390 of the crankcase 110 (see FIG. 5) upward to the gears 320. The incoming line 270 to the oil filter 260 is coupled to one of the shafts 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Further referring to FIG. 7, and additionally to FIG. 8, elements of a valve train 460 of the engine 100 are shown. The valve train 460 includes the gears 320 resting upon the shafts 410 and also includes the cams 360 underneath the gears, respectively. Additionally, respective cam follower arms 470 that are rotatably mounted to the crankcase 110 extend to rest upon the respective cams 360. The respective push rods 340, 342 in turn rest upon the respective cam follower arms 470. As the cams 360 rotate, the push rods 340, 342 are temporarily forced axially outward away from the crankcase 110 by the cam follower arms 470. This causes the rocker arms 350, 352 to rock or rotate, and consequently causes the respective valves 240 and 250 to move axially toward the crankcase 110. As the cams 360 continue to rotate, however, the push rods 340, 342 are allowed by the cam follower arms 470 to return inward to their original positions.

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cams 360 could be located above the gears 320 rather than underneath the gears.

While the foregoing specification illustrates and describes the preferred embodiments of this invention, it is to be understood that the invention Is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

We claim:

1. An internal combustion engine comprising:

a crankcase;

a cylinder having a proximal end and a distal end, said proximal end being fixed to said crankcase;

a cylinder head covering said distal end of said cylinder;

an intake passage formed in said cylinder head, and opening toward a first side of said cylinder head for guiding combustible material to said cylinder;

an exhaust passage formed in said cylinder head, and opening toward a second side of said cylinder head which is opposite to said first side for guiding exhaust gasses away from said cylinder;

an intake valve for controlling the flow of combustible material into said cylinder barrel through said intake passage, said intake valve including an intake valve stem extending through said cylinder head;

an exhaust valve for controlling the flow of exhaust gasses out of said cylinder barrel through said exhaust passage, said exhaust valve including an exhaust valve stem extending through said cylinder head, wherein said intake valve stem and said exhaust valve stem define a central valve region therebetween;

an intake rocker arm pivotally mounted relative to said cylinder head, said intake rocker arm having a first end engaging said intake valve stem and a second end extending toward said first side of said cylinder head, wherein pivotal movement of said intake rocker arm axially moves said intake valve stem to move said intake valve between an open position and a closed position;

an exhaust rocker arm pivotally mounted relative to said cylinder head, said exhaust rocker arm having a first end engaging said exhaust valve stem and a second end extending toward said second side of said cylinder head, wherein pivotal movement of said exhaust rocker arm axially moves said exhaust valve stem to move said exhaust valve between an open position and a closed position;

an intake push rod adjacent said first side of said cylinder head and engaging said intake rocker arm to pivot said intake rocker arm;

an exhaust push rod adjacent said second side of said cylinder head and engaging said exhaust rocker arm second end to pivot said exhaust rocker arm; and a fan rotatably mounted relative to said crankcase for forcing cooling air over said exhaust passage said exhaust passage fixed to said exhaust passage extends substantially perpendicular to.

2. The internal combustion engine as in claim 1, in which at least one of said intake push rod and said exhaust push rod extends through said cylinder head.

3. The internal combustion engine as in claim 1, in which said intake push rod and intake valve stem lie in an intake plane, and said exhaust push rod and said exhaust valve stem lie in an exhaust plane which intersects said intake plane.

4. The internal combustion engine as in claim 1, in which said intake push rod is adjacent to said intake passage.

5. The internal combustion engine as in claim 1, in which said exhaust push rod is adjacent to said exhaust passage.

6. The internal combustion engine as in claim 1, in which said intake plane and said exhaust plane intersect to form an angle of at least 90°.

7. The internal combustion engine as in claim 1, in which said cylinder head includes a body and a bridge spaced from said body, wherein at least one of said valve stems extend through said body and said bridge.

8. The internal combustion engine 7, in which said exhaust passage extends into a space defined by said bridge and said body.

9. The internal combustion engine as in claim 7, in which at least one of said push rods extends through a tube, said tube having at least a portion extending between said body and said bridge.

10. The internal combustion engine, as in claim 9, in which said tube supports said bridge spaced from said body.

11. A cross-flow cylinder head assembly comprising:

a cylinder head body;

a bridge spaced from said cylinder head body;

an intake passage formed in said cylinder head body, and opening toward a first side of said cylinder head body for guiding combustible material to a cylinder;

an exhaust passage formed in said cylinder head body, and opening toward a second side of said cylinder head body which is opposite to said first side for guiding exhaust gasses away from said cylinder;

a first tube extending between said body and bridge for receiving an intake valve stem;

a second tube extending between said body and said bridge for receiving an exhaust valve stem, wherein said first tube and said second tube define a central valve region therebetween;

an intake rocker arm pivotally mounted relative to said bridge, said intake rocker arm having a first end engageable with the intake valve stem and a second end extending toward said first side of said cylinder head body and engageable with an intake push rod, wherein pivotal movement of said intake rocker arm axially moves the intake valve stem;

an exhaust rocker arm pivotally mounted relative to said bridge, said exhaust rocker arm having a first end engageable with the exhaust valve stem and a second end extending toward said second side of said cylinder head body, and engageable with an exhaust push rod, wherein pivotal movement of said exhaust rocker arm axially moves the exhaust valve stem;

a third tube adjacent said first side of said cylinder head, and extending between said body and said bridge for receiving the intake push rod;

a fourth tube adjacent said second side of said cylinder head, and extending between said body and said bridge for receiving the exhaust push rod engaging said exhaust rocker arm second end to pivot said exhaust rocker arm, and a fan rotatable mounted relative to said exhaust passage for forcing cooling air over said exhaust passage.

12. The cylinder head as in claim 11, in which at least one of said third tube and fourth tube is coaxial with an opening extending through said cylinder head body.

13. The cylinder head as in claim 11, in which said first tube and said third tube lie in an intake plane, and said second tube and said fourth tube lie in an exhaust plane which intersects said intake plane.

14. The cylinder head as in claim 11, in which said third tube is adjacent to said intake passage.

15. The cylinder head as in claim 11, in which said fourth tube is adjacent to said exhaust passage.

16. The cylinder head as in claim 11, in which said intake plane and said exhaust plane intersect to form an angle of at least 90°.

17. The cylinder head as in claim 11, in which at least one of said tubes support said bridge spaced from said body.

18. The cylinder head as in claim 11, in which said exhaust passage extends into a space defined by said bridge and said body.

* * * * *

UNITED STATES PATENT AND TRADEMARK OFFICE

CERTIFICATE OF CORRECTION

PATENT NO. : 6,739,304 B2 
DATED : May 25, 2004
INVENTOR(S) : David B. Reinbold, Robert W. Richards and Terrence M. Rotter It is certified that error appears in the above-identified patent and that said Letters Patent is hereby corrected as shown below:

Column 2,
Line 19, "stern" should be -- stem --.

Column 3,
Line 36, "a" should be -- as --.

Column 4,
Line 13, "3" should be -- 174 --.

Column 7,
Lines 27-29, please delete "said exhaust passage fixed to said exhaust passage extends substantially perpendicular to."

Column 8,
Line 37, "rotatable" should be -- rotatably --.

Signed and Sealed this

Twenty-fifth Day of January, 2005

JON W. DUDAS
*Director of the United States Patent and Trademark Office*